US008359990B2

(12) United States Patent
Totsu

(10) Patent No.: US 8,359,990 B2
(45) Date of Patent: Jan. 29, 2013

(54) BOBBIN HOLDING MEMBER AND STORAGE CASE

(75) Inventor: Yoko Totsu, Sendai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 520 days.

(21) Appl. No.: 12/654,743

(22) Filed: Dec. 30, 2009

(65) Prior Publication Data

US 2010/0107948 A1 May 6, 2010

Related U.S. Application Data

(63) Continuation-in-part of application No. PCT/JP2008/060951, filed on Jun. 16, 2008.

(30) Foreign Application Priority Data

Jul. 17, 2007 (JP) ..... 2007-185861

(51) Int. Cl.
*D05B 57/26* (2006.01)
*B65H 75/02* (2006.01)

(52) U.S. Cl. ..... 112/231; 242/595; 206/225

(58) Field of Classification Search ..... 242/118–118.7, 242/595; 206/225, 389; 112/279, 228–231, 112/302

See application file for complete search history.

(56) References Cited

U.S. PATENT DOCUMENTS

| | | | | |
|---|---|---|---|---|
| 820,596 | A * | 5/1906 | Norwood | 225/38 |
| 2,031,851 | A * | 2/1936 | Plunkett | 206/389 |
| 4,510,953 | A * | 4/1985 | Caruso | 132/228 |
| 4,664,260 | A * | 5/1987 | Stokes | 206/386 |
| 4,998,685 | A * | 3/1991 | Spencer | 242/137 |
| 5,211,353 | A * | 5/1993 | Lewin et al. | 242/118.41 |
| 7,100,856 | B2 * | 9/2006 | Murphy, Jr. | 242/118.41 |

FOREIGN PATENT DOCUMENTS

| | | |
|---|---|---|
| JP | A-41-000596 | 1/1966 |
| JP | U-48-092160 | 11/1973 |
| JP | U-48-098361 | 11/1973 |
| JP | U-51-028243 | 3/1976 |
| JP | U-55-170078 | 12/1980 |
| JP | A-57-187177 | 11/1982 |
| JP | U 57-187177 | 11/1982 |
| JP | U-61-025369 | 2/1986 |
| JP | B2-02-062277 | 12/1990 |
| JP | A-04-017765 | 2/1992 |
| JP | U 4-017765 | 2/1992 |
| JP | U-06-038883 | 5/1994 |
| JP | A-10-005476 | 1/1998 |
| JP | A-10-099583 | 4/1998 |
| JP | A-2000-310833 | 11/2000 |
| JP | U-3084959 | 4/2002 |

(Continued)

OTHER PUBLICATIONS

May 22, 2012 Japanese Office Action issued in Japanese Patent Application No. 2007-185861 (with translation).

(Continued)

*Primary Examiner* — Ismael Izaguirre
(74) *Attorney, Agent, or Firm* — Oliff & Berridge, PLC

(57) ABSTRACT

A bobbin holding member holds a bobbin, and the bobbin holding member includes a body portion that holds detachably an outer periphery of a brim portion provided to both ends of a middle body section of the bobbin, wherein the body portion includes a fitting portion and a fitting target portion to be fitted to the fitting portion of any of the other bobbin holding members.

5 Claims, 20 Drawing Sheets

FOREIGN PATENT DOCUMENTS

| | | |
|---|---|---|
| JP | A-2003-048670 | 2/2003 |
| JP | A-2006-088501 | 4/2006 |
| JP | A-2006-271502 | 10/2006 |

OTHER PUBLICATIONS

International Search Report issued in International Application No. PCT/JP2008/060951 on Jul. 8, 2008 (w/ translation).

Dec. 6, 2011 Japanese Office Action issued in Japanese Patent Application No. 2007-185861 (with translation).

Written Opinion of the International Searching Authority issued in related International Application No. PCT/JP2008/060951 mailed Jul. 8, 2008. (with English-language translation).

* cited by examiner

BOBBIN HOLDING MEMBER AND STORAGE CASE

CROSS-REFERENCE TO RELATED APPLICATION

This application is a U.S. continuation-in-part application filed under 35 USC 111(a) claiming benefit under 35 USC 120 and 365(c) of International Application No. PCT/JP2008/060951, filed Jun. 16, 2008, which claims priority to Application Ser. No. 2007-185861, filed in Japan on Jul. 17, 2007. The disclosure of the foregoing applications is hereby incorporated by reference in their entireties.

BACKGROUND

The present disclosure relates to a bobbin holding member that holds a bobbin to be used in a sewing machine and a storage case for it.

Conventionally, a bobbin (thread winder) for use in a sewing machine has been generally stored in an accessory storage case of the body of the sewing machine or a tidy. However, a thread wound around the bobbin may have been released and entangled in the storage case or the tidy. Furthermore, when taking out the bobbin and using it, it has been necessary to disentangle the thread or rewind it around the bobbin by hand, resulting in troublesome handling. To solve the problem, for example, a thread winding clip has been proposed which is shaped like a circle having one open end by externally folding back both edges of a plate made of metal etc. The bobbin is arranged to be sandwiched when its body section is pressed into the inner thread winding clip. Then, a plurality of such thread winding clips can be fixed inside the storage case or the tidy with an adhesive agent, to easily store a plurality of the bobbins in a condition where they are set in order. Besides, such a bobbin tidy structure has been proposed that U-shaped cross-sectional bobbin catching strips each of which laterally sandwiches the middle body section of the bobbin may be lined up on the inner bottom surface of the tidy.

However, the thread winding clips described above can be fixed on inside a tidy etc. to store the bobbins in order, and if the thread winding clips are unfixed, they may be scattered in the tidy, thus problematically disabling storing the bobbins in order. Moreover, once the thread winding clips are fixed on inside the tidy etc. with an adhesive agent, they cannot be detached, thereby restricting a space for storing the bobbins in the tidy. It may lead also to such poor usability that accessories (for example, a pair of scissors, various pressers, needles, screwdrivers, etc.) other than the bobbins cannot newly be stored in the tidy. On the other hand, the bobbin tidy described above has bobbin catching strips lined up on its inner bottom surface, so that most of the inner space of the tidy may be occupied by storing the bobbins. This may also has a problem that is similar to that of the aforesaid thread winding clip that the accessories other than the bobbins cannot be stored so much.

SUMMARY

To solve the problems, the present disclosure has been developed, and an object of the present disclosure is to provide a bobbin holding member that can facilitate storing bobbins in order and a storage case that can sufficiently store even accessories other than the bobbins by utilizing the bobbin holding member.

According to a first aspect of the present disclosure, a bobbin holding member is provided that holds a bobbin, the member comprising a body portion that holds detachably an outer periphery of a brim portion provided to both ends of a middle body section of the bobbin, wherein the body portion includes a fitting portion and a fitting target portion to be fitted to the fitting portion of any of the other bobbin holding members.

According to a second aspect of the present disclosure, a storage case that stores sewing machine accessories, the case comprising a bottom wall; and a side wall erected from an outer peripheral edge of the bottom wall, wherein on an inner side surface of the side wall, a case-side fitting portion is provided which is fitted to the fitting portion or the fitting target portion provided on the bobbin holding member described above.

According to a third aspect of the present disclosure, a storage case is provided that stores sewing machine accessories, the case comprising a case body whose one surface is open; and a cap that covers an open surface of the case body, wherein on a back surface of the cap, a cap-side fitting portion is provided which is fitted to the fitting portion or the fitting target portion provided on the bobbin holding member described above.

BRIEF DESCRIPTION OF THE DRAWINGS

Exemplary embodiments will be described below in detail with reference to the accompanying drawings in which.

DESCRIPTION OF THE PREFERRED EMBODIMENTS

A description will be given of bobbin holding clips 10 and 20 in accordance with first and second embodiments as well as storage cases 30 and 50 in accordance with third and fourth embodiments of the present disclosure in this order with reference to the drawings. It should be noted that the bobbin holding clips 10 and 20 (see FIGS. 1 and 12 respectively) in accordance with the first and second embodiments are used to hold a known bobbin 60 (see FIG. 7), around which a thread is wound. Further, the storage cases 30 and 50 (see FIGS. 17 and 19 respectively) in accordance with the third and fourth embodiments may be fitted with a bobbin holding clip 10 (20) detachably so that they can store sewing machine accessories including the bobbin 60 in order.

First, a description will be given of the bobbin holding clip 10 in accordance with the first embodiment with reference to FIGS. 1 to 6.

Figure 1:
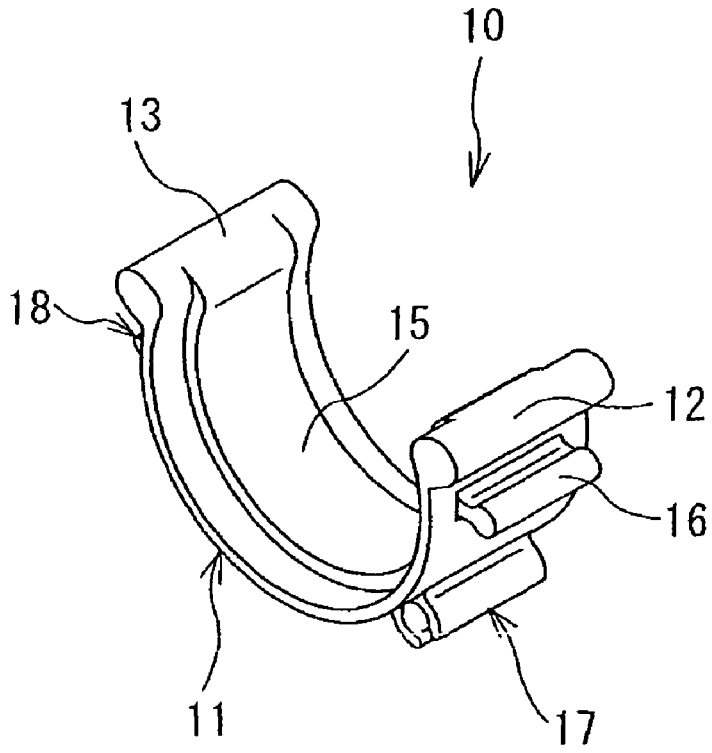
FIG. 1 is a perspective view of a bobbin holding clip.
Figure 2:
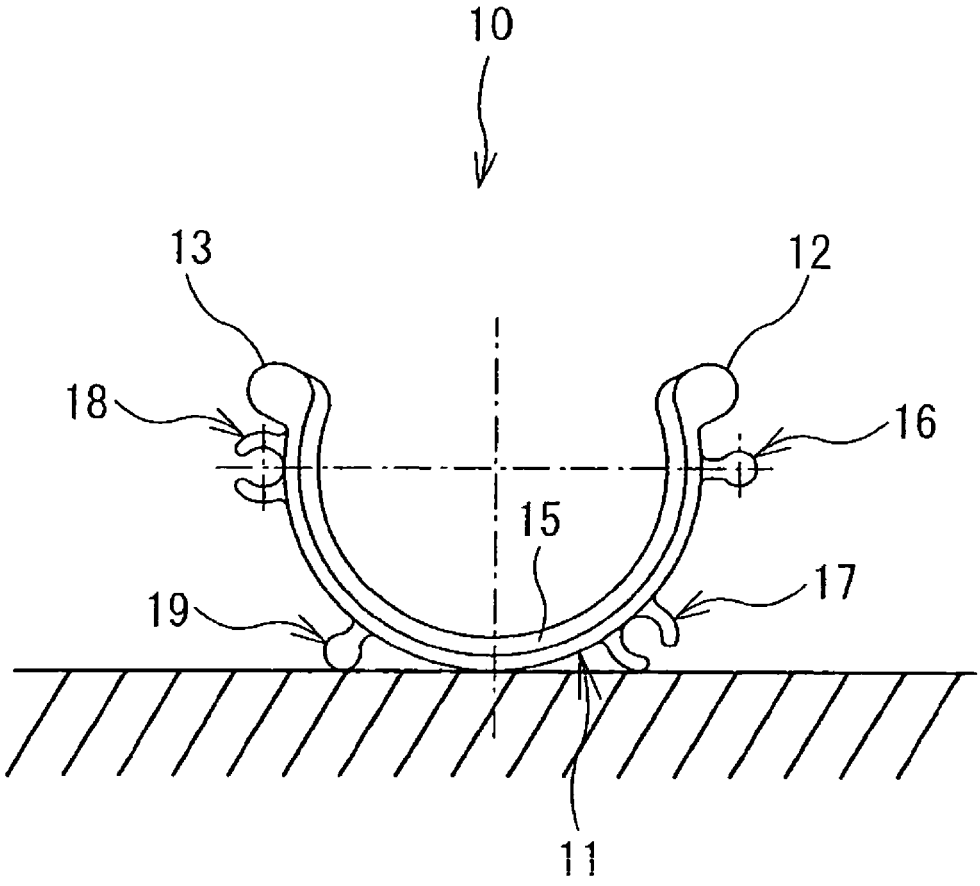
FIG. 2 is a front view of the bobbin holding clip.
Figure 3:
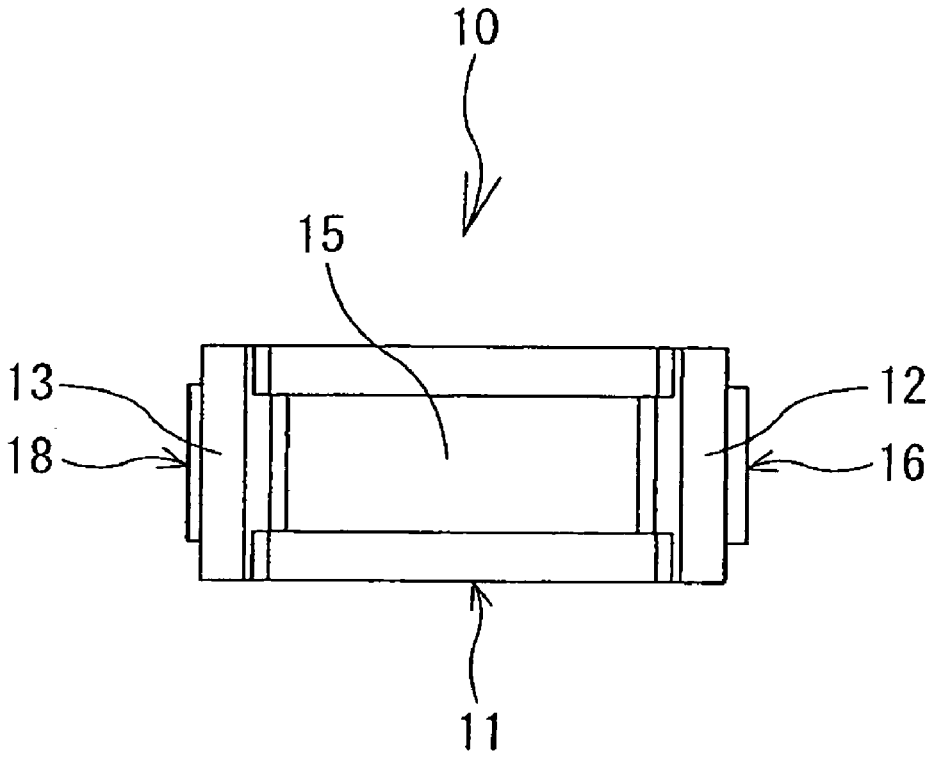
FIG. 3 is a plan view of the bobbin holding clip.
Figure 4:
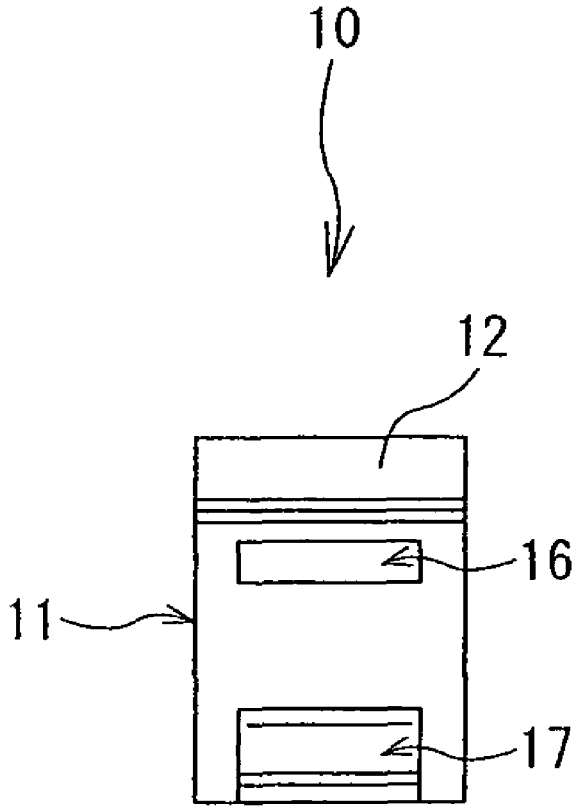
FIG. 4 is a right side view of the bobbin holding clip.
Figure 5:
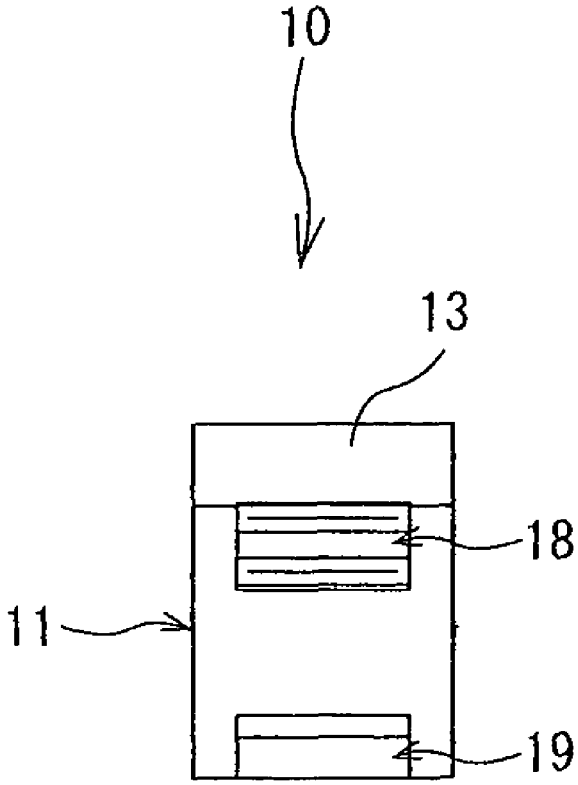
FIG. 5 is a left side view of the bobbin holding clip.
Figure 6:
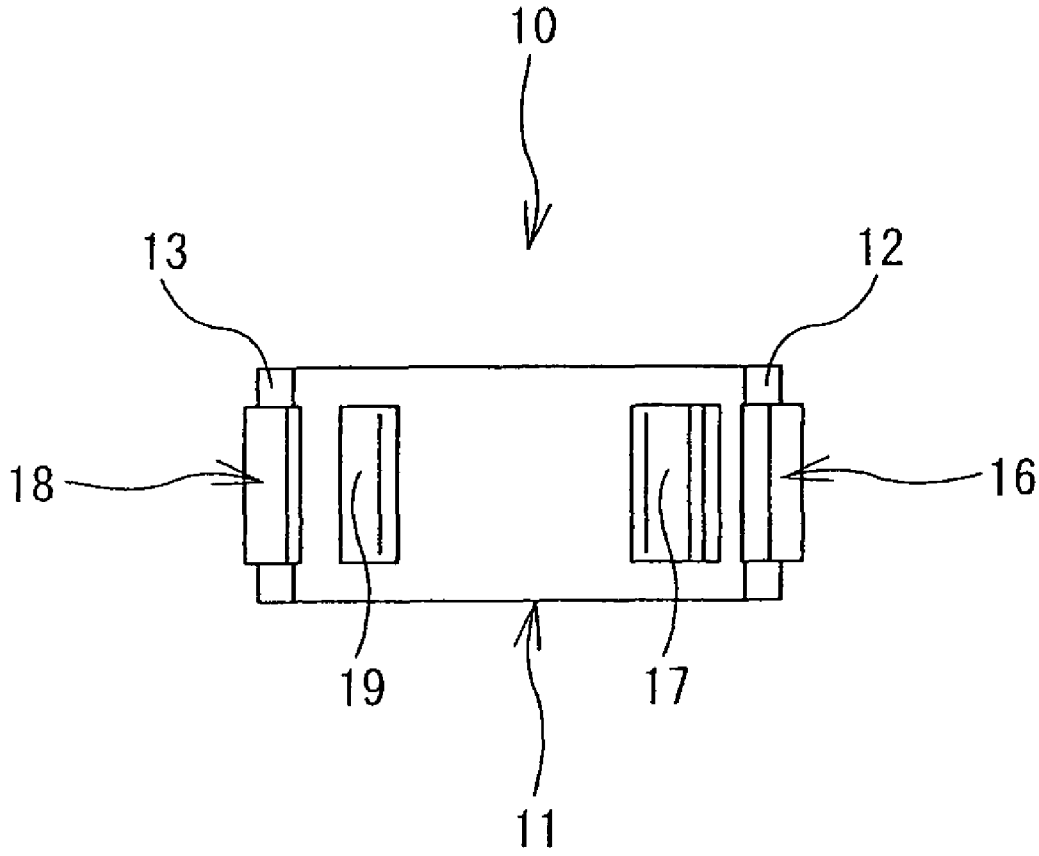
FIG. 6 is a bottom view of the bobbin holding clip.
Figure 7:
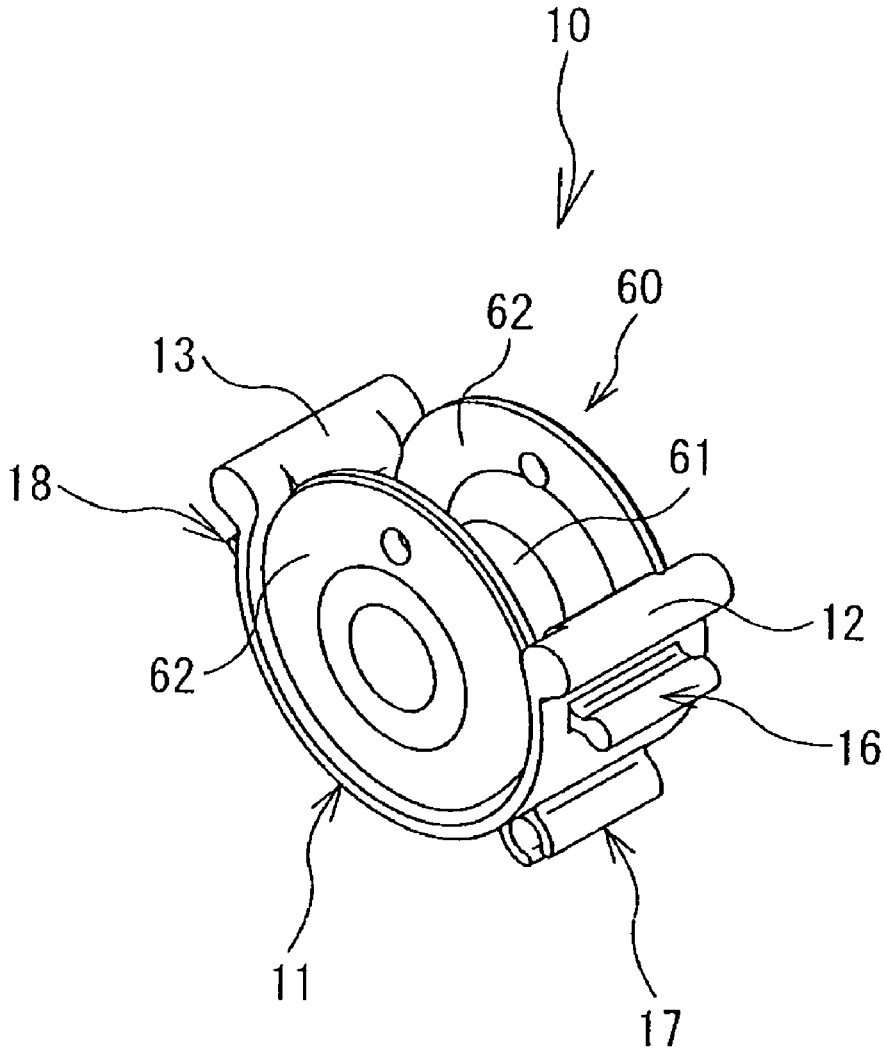
FIG. 7 is a perspective view showing a state in which a bobbin is held by the bobbin holding clip.

First, the structure of the bobbin holding clip 10 will be described. As shown in FIGS. 1 and 2, the bobbin holding clip 10 comprises a body portion 11 which is made of an elastically deformable synthetic resin and formed in a C-shape as viewed from front. The both ends of the body portion 11 where it opens in a direction perpendicular to its width direction in a condition where it opens upward are respectively provided with a right-side opening end portion 12 which expands rightward in the cross-sectional shape of a semicircle and a left-side opening end portion 13 which expands leftward in the cross-sectional shape of a semicircle. Further, the body portion 11 is arranged to have a slightly small inner radius than a radius of a brim portion 62 of the bobbin 60. At its width-directional middle portion on the inner peripheral surface of the body portion 11, a wall thickness portion 15 having a width comparable to the length of a middle body section 61 of the bobbin 60 shown in FIG. 7 is provided.

Also, as shown in FIGS. 1 to 6, at the upper stage on the right-side outer peripheral surface of the body portion 11, a first fitting portion 16 is provided which extends in the width direction of the body portion 11 and projects rightward and whose projecting tip expands in an Ω-shape. Further, below the first fitting portion 16, a first fitting target portion 17 is provided which extends in the width direction of the body portion 11 and is formed in a cross-sectional C-shape and opens lower rightward obliquely. On the other hand, also at the upper stage on the left-side outer peripheral surface of the body portion 11, a second fitting target portion 18 is provided which extends in the width direction of the body portion 11 and is formed in a cross-sectional C-shape and opens leftward. Further, below the second fitting target portion 18, a second fitting portion 19 is provided which extends in the width direction of the body portion 11 and projects leftward and whose projecting tip expands in an Ω-shape.

The first fitting portion 16 and the second fitting portion 19 are arranged so that they can be fitted to any one of the first fitting target portion 17 and the second fitting target portion 18 on another bobbin holding clip 10. It should be noted that as shown in FIG. 2, the center position of the first fitting portion 16 (center position of an Ω-shaped partial cylinder) and the center position of the second fitting target portion 18 (center position of a cross-sectional C-shaped partial cylinder hollow) are disposed so that they may be of substantially the same height and in a plane which passes through the center position of the body portion 11 (center position of the cross-sectional C-shaped partial cylinder hollow) or in the vicinity thereof. Thus, a plurality of the bobbin holding clips 10 can be serially connected in one row. It should be noted that a method for serially connecting the plurality of bobbin holding clips 10 will be described later.

Further, the first fitting target portion 17 and the second fitting portion 19 are respectively disposed so that each of the lowest positions of the first fitting target portion 17, the second fitting portion 19, and the body portion 11 may be in substantially the same plane. Thus, the bobbin holding clips 10 can be stably put on a flat surface, because they may not roll over even if they are put on a flat surface such as a work table in such a posture as shown in FIG. 2.

Next, a description will be given of a method for holding the bobbin 60 on the bobbin holding clip 10 having the aforesaid structure, with reference to FIGS. 1, 7, and 8.

First, the bobbin 60 is disposed so that its middle body section 61 (see FIG. 7) may face to the opening of the bobbin holding clip 10 shown in FIG. 1. Subsequently, the brim portions 62 of the bobbin 60 are pressed into the opening of the bobbin holding clip 10. Then, the brim portions 62 of the bobbin 60 contact with the respective inner surfaces of the right-side opening end portion 12 and the left-side opening end portion 13 of the bobbin holding clip 10, so that the right-side opening end portion 12 and the left-side opening end portion 13 may be pressed outward to widen the opening. As the brim portions 62 are pressed in further, their outer edges contact with the inner peripheral surfaces of the body portion 11 of the bobbin holding clip 10. Then, as shown in FIG. 7, the bobbin 60 is taken in and held inside the bobbin holding clip 10. Further, in this condition, the body portion 11 of the bobbin holding clip 10 is pressured outward, so that the elastic recovery force of the body portion 11 causes the bobbin 60 to be caught inward so that it may be held securely. In this condition, the brim portions 62 of the bobbin 60 are locked at the edges of the wall thickness portion 15 of the bobbin holding portion 10, so that the bobbin 60 can be prevented from coming off.

Figure 8:
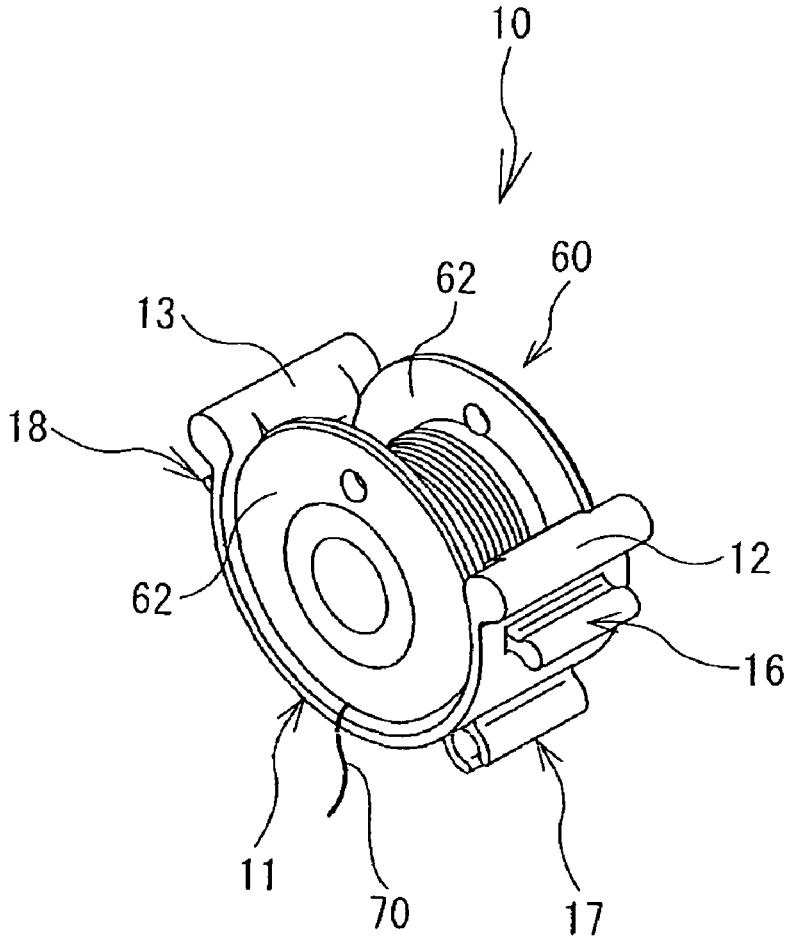
FIG. 8 is a perspective view showing a state in which the bobbin around which a thread is wound is held by the bobbin holding clip.

Further, in a case where the bobbin 60 which a thread 70 is wound around is held in the bobbin holding clip 10 as shown in FIG. 8, the end of the thread 70 may be pulled out beforehand from between the outer edge of one of the brim portions 62 of the bobbin 60 and the inner peripheral surface of the body portion 11 of the bobbin holding clip 10. Thus, the end of the thread 70 is held in a condition where it is sandwiched between the outer edge of the brim portions 62 and the inner peripheral surface of the body portion 11, so that the thread 70 can be prevented from being loosened.

Figure 9:
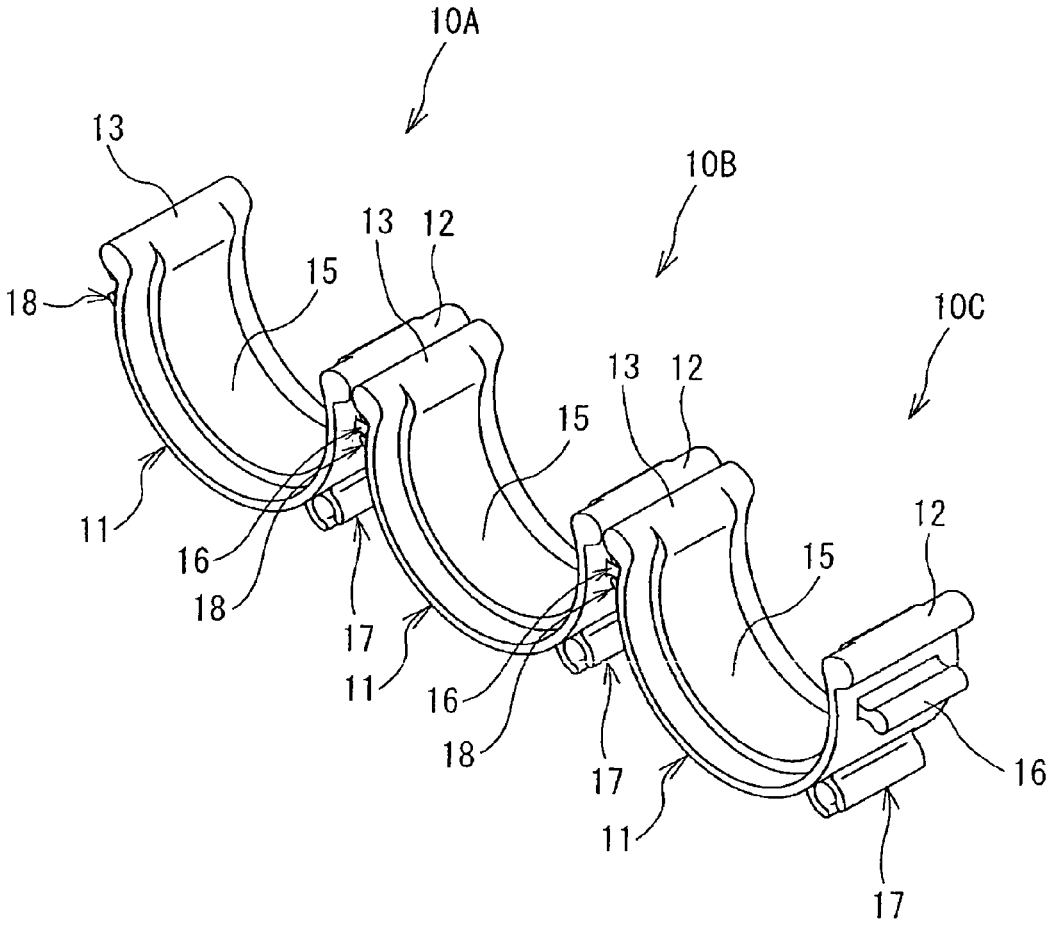
FIG. 9 is a perspective view showing a state in which three bobbin holding clips 10A to 10C are serially connected in a row direction.
Figure 10:
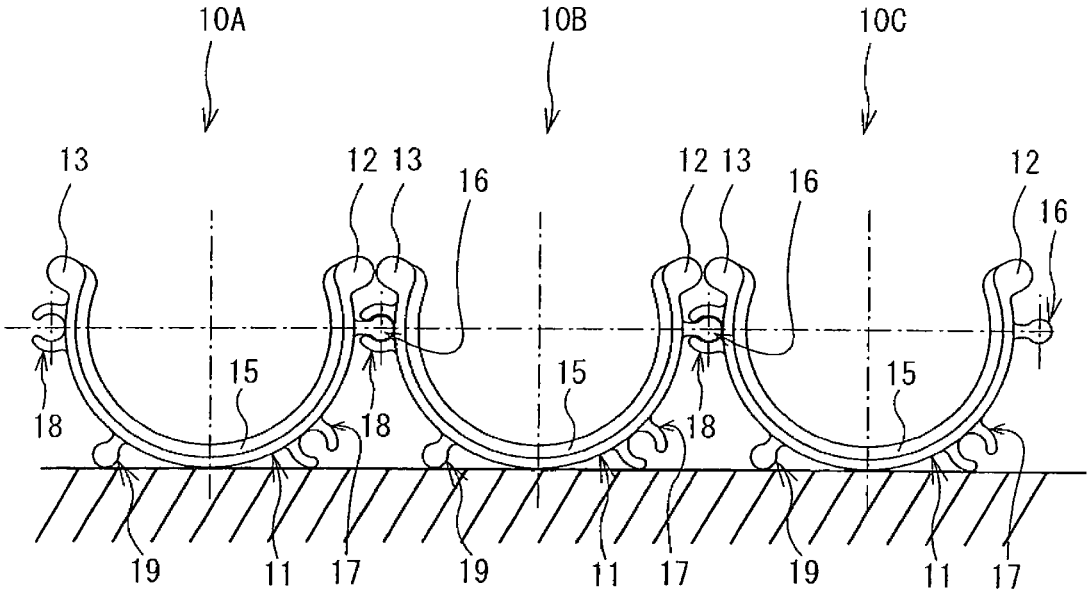
FIG. 10 is a front view showing a state in which the three bobbin holding clips 10A to 10C are serially connected in the row direction.
Figure 11:
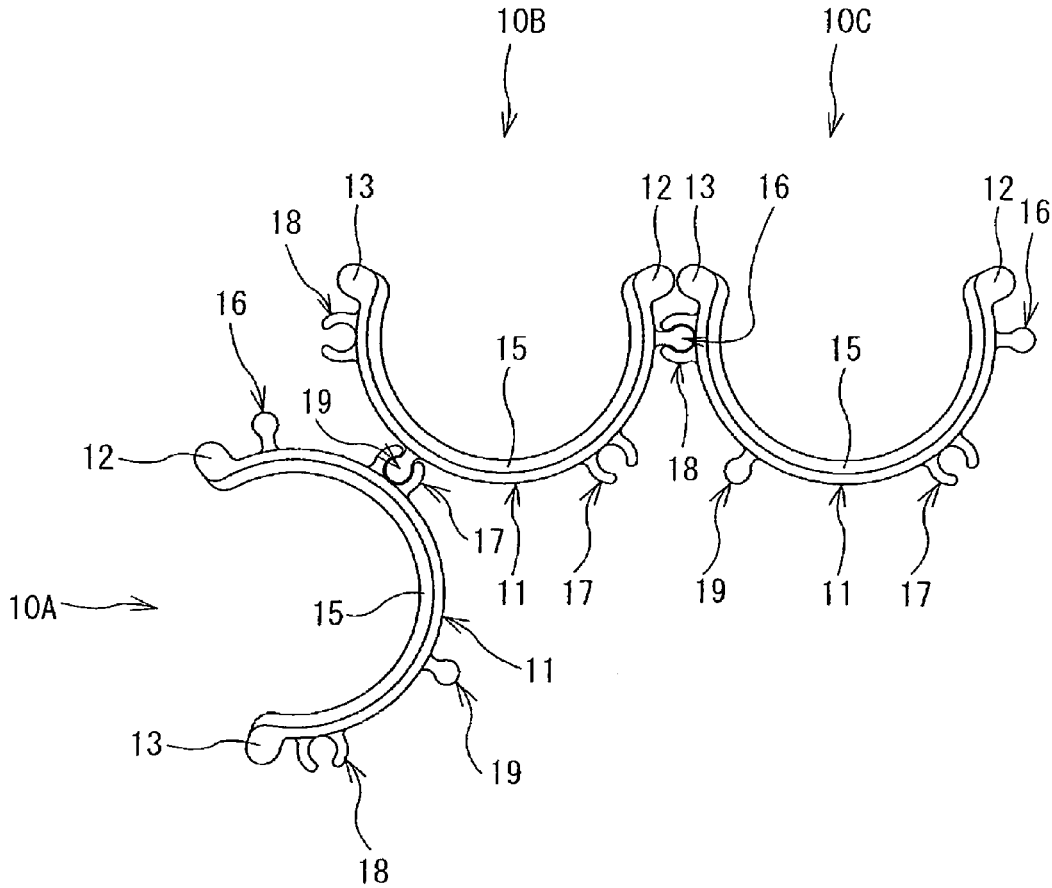
FIG. 11 is a front view showing another state in which three bobbin holding clips 10A to 10C are serially connected.

Next, a description will be given of the method for connecting serially three bobbin holding clips 10A, 10B, and 10C with reference to FIGS. 9 to 11. As shown in FIGS. 9 and 10, for example, they are disposed in a line in the row direction in such a manner that the bobbin holding clip 10A may come to the left, the bobbin holding clip 10B may come to the center, and the bobbin holding clips 10C may come to the right. In this condition, the first fitting portion 16 of the bobbin holding clip 10A, the first fitting portion 16 and the second fitting target portion 18 of the bobbin holding clip 10B, and the second fitting target portion 18 of the bobbin holding clip 10C are all of the same height.

Then, the first fitting portion 16 of the bobbin holding clip 10A is pressed into the second fitting target portion 18 of the bobbin holding clip 10B so that the clip 10A may be fitted in. In such a manner, the bobbin holding clips 10A and 10B can be serially connected with each other. Subsequently, the first fitting portion 16 of the bobbin holding clip 10B is pressed into the inner second fitting target portion 18 of the bobbin holding clip 10C so that the clip 10B may be fitted in. Thus, the bobbin holding clips 10A, 10B, and 10C can be serially connected in the row direction. In this condition, the right-side opening end portion 12 and the left-side opening end portion 13 are in contact with each other over these connected bobbin holding clips 10A, 10B, and 10C. Therefore, with respect to the central bobbin holding clip 10B, the left-side bobbin holding clip 10A can be turned counterclockwise around the first fitting portion 16 of the bobbin holding clip 10A but not clockwise. Further, the right-side bobbin holding clip 10C can be turned clockwise around the second fitting target portion 18 of the bobbin holding clip 10C but not counterclockwise. Therefore, if the bobbin holding clips 10A, 10B, and 10C are put on a flat surface such as a work table in such a posture as shown in FIG. 10, they can be placed stably in a condition where they are held in a connected posture.

Further, as aforesaid, the outer peripheral surface of the body portion 11 of the bobbin holding clip 10 is provided with the first fitting portion 16, the first fitting target portion 17, the second fitting target portion 18, and the second fitting portion 19. It enables connecting serially other bobbin holding clips 10 to one bobbin holding clip 10 in its four directions of the right side, the left side, the lower right side, and the lower left side in a condition that these clips may be placed side by side. For example, as shown in FIG. 11, the bobbin holding clip 10B can be connected with the bobbin holding clip 10C in the row direction and only with the bobbin holding clip 10A on the lower left side of the bobbin holding clip 10B. In this case, the second fitting portion 19 of the bobbin holding clip 10B may be fitted to the second fitting target portion 17 of the bobbin holding clip 10A. By thus utilizing the first fitting target portion 17 and the second fitting portion 19, the clips can be connected in various forms. It should be noted that although the present embodiment has been described with reference to a form of serially connecting the three bobbin holding clips, of course, two, four, or more of the bobbin holding clips 10 can be connected with each other in a variety of forms.

As described above, the bobbin holding clip 10 of the first embodiment comprises the body portion 11 which is made of an elastically deformable synthetic resin and formed in the C-shape as viewed from front. On the outer peripheral surface of the body portion 11 are provided with the first fitting portion 16, the first fitting target portion 17, the second fitting target portion 18, and the second fitting portion 19. It enables connecting other bobbin holding clips 10 to one bobbin holding clip 10 in its four directions of the right side, the left side, the lower right side, and the lower left side in a condition that these clips may be placed side by side. With this, a plurality of the bobbin holding clips 10 can be stored in, for example, a drawer in a condition where they are connected with each other so that bobbin holding clips 10 may be prevented from being scattered. Thus, the bobbins 60 can be stored in order. Further, a plurality of the bobbin holding clips 10 can be grouped in accordance with the color or the type of the thread 70 wound around the bobbins 60 held in the bobbin holding clips 10, thereby connecting the bobbin holding clips 10 in each of the groups. Thus, a plurality of the bobbins 60 can be placed in order on a work table, so that easily identifying the bobbin 60 around which a desired thread 70 is wound.

Next, a bobbin holding clip 20 of a second embodiment will be described with reference to FIGS. 12 to 16.

It should be noted that the bobbin holding clip 20 is a variant of the bobbin holding clip 10 according to the first embodiment, so that bobbin holding clips 20 can be connected to another clip 20 not only in the row direction but also in the column direction. Further, the bobbin holding clip 20 is the bobbin holding clips 10 added new structural components. Therefore, in the following description, the same reference numerals are given to the same components as those of the bobbin holding clip 10 of the first embodiment and repetitive description on the identical components will be omitted, thus mainly describing the new components and their functions.

Figure 12:
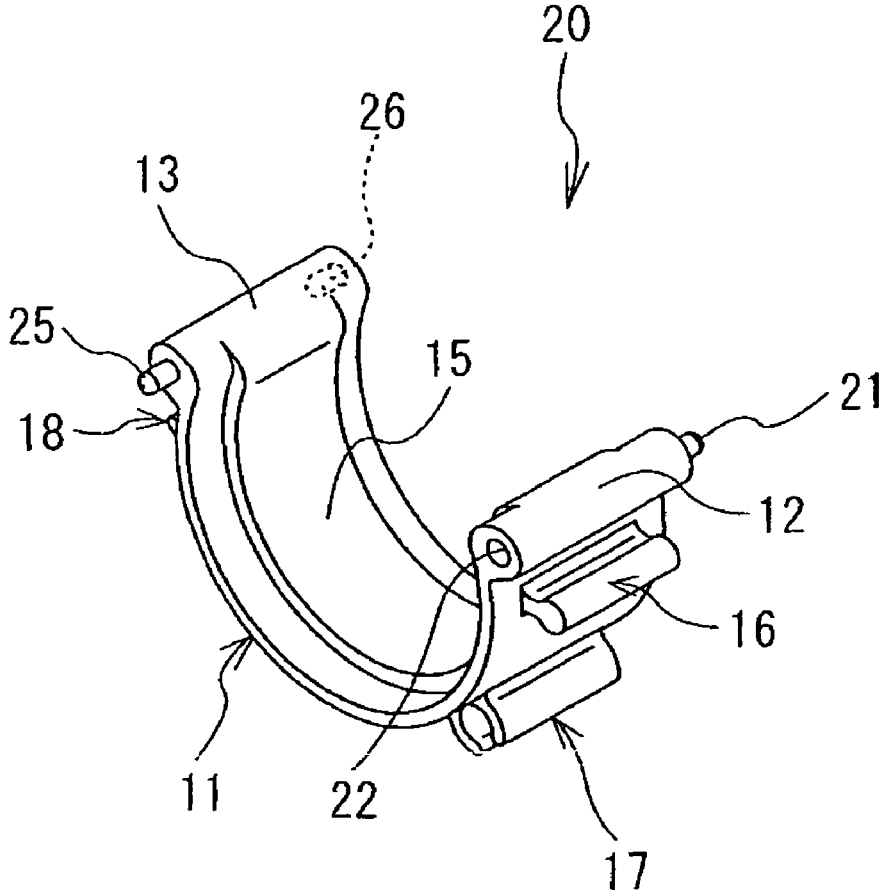
FIG. 12 is a perspective view of a bobbin holding clip.
Figure 13:
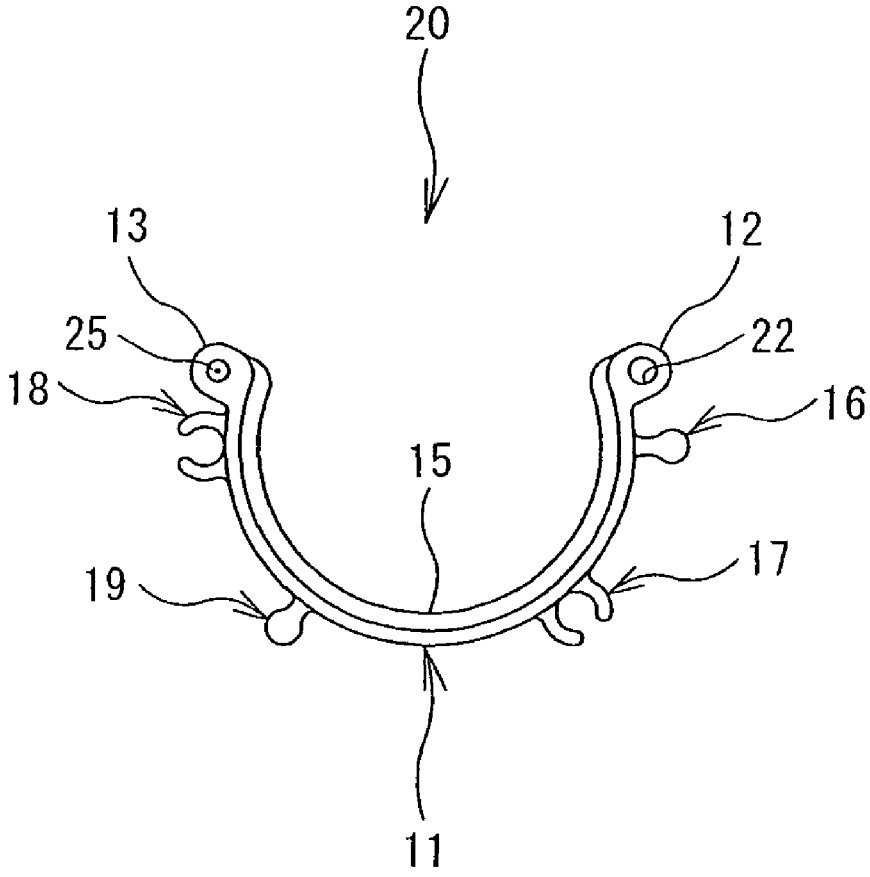
FIG. 13 is a front view of the bobbin holding clip.

As shown in FIGS. 12 and 13, the bobbin holding clip 20 has all the components and functions of the bobbin holding clip 10 of the first embodiment shown in FIG. 1. Further, at the center of the rear end portion of the right-side opening end portion 12 which expands in the semicircular cross-sectional shape of the body portion 11, a cylindrical protrusion portion 21 is formed which has a smaller diameter than that of this right-side opening end portion 12 and projects rearward. Moreover, at the front end portion of the right-side opening end portion 12, a recessed fitting hole 22 is formed which has a circular shape as viewed from front. The central axis line of the protrusion portion 21 and the central axis line of the fitting hole 22 are arranged to be on the same line. Further, the protrusion portion 21 is fitted to be fitted into the fitting hole 22 of any other bobbin holding clip 20.

On the other hand, also at the center of the front end portion of the left-side opening end portion 13 which expands in the semicircular cross-sectional shape of the body portion 11, a cylindrical protrusion portion 25 is formed which has a smaller diameter than that of this left-side opening end portion 13 and projects frontward. Moreover, at the rear end portion of the left-side opening end portion 13, a recessed fitting hole 26 is formed which has a circular shape as viewed from front. The central axis line of protrusion portion 25 and the central axis line of the fitting hole 26 are arranged to be on the same line. Further, the protrusion portion 25 is arranged to be fitted into the fitting hole 26 of any other bobbin holding clip 20.

Figure 14:
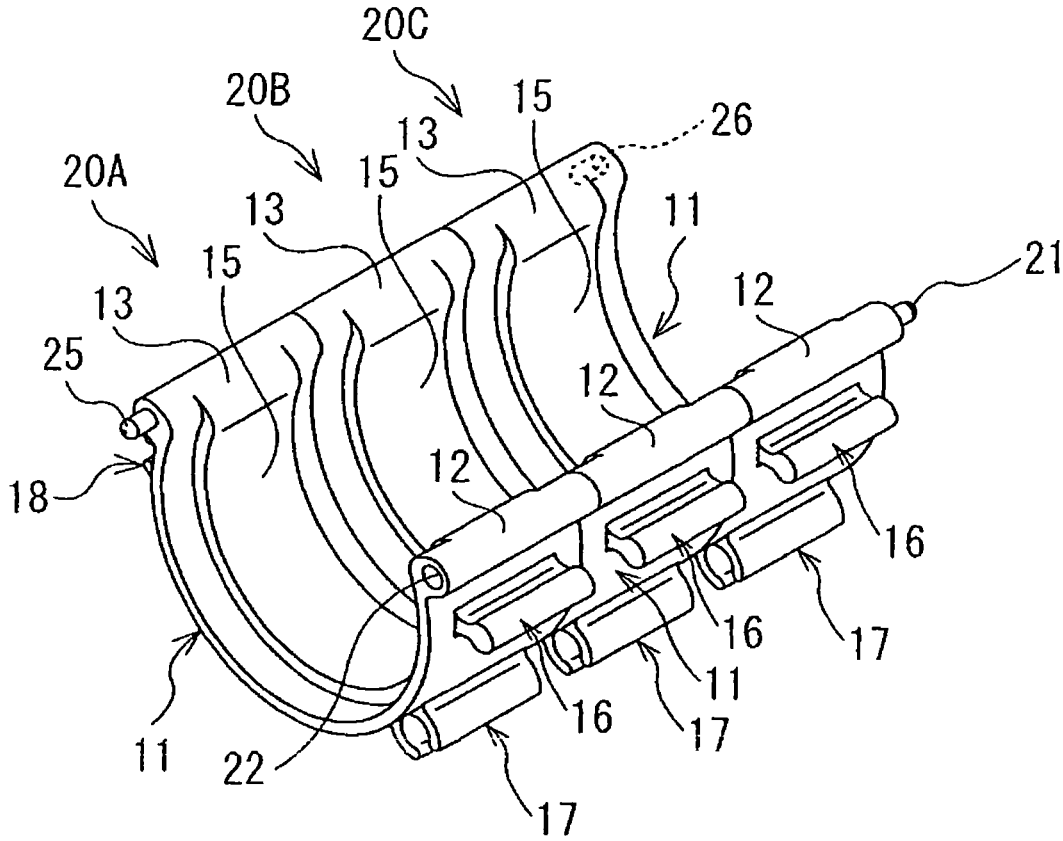
FIG. 14 is a perspective view showing a state in which three bobbin holding clips are serially connected in a column direction.
Figure 15:
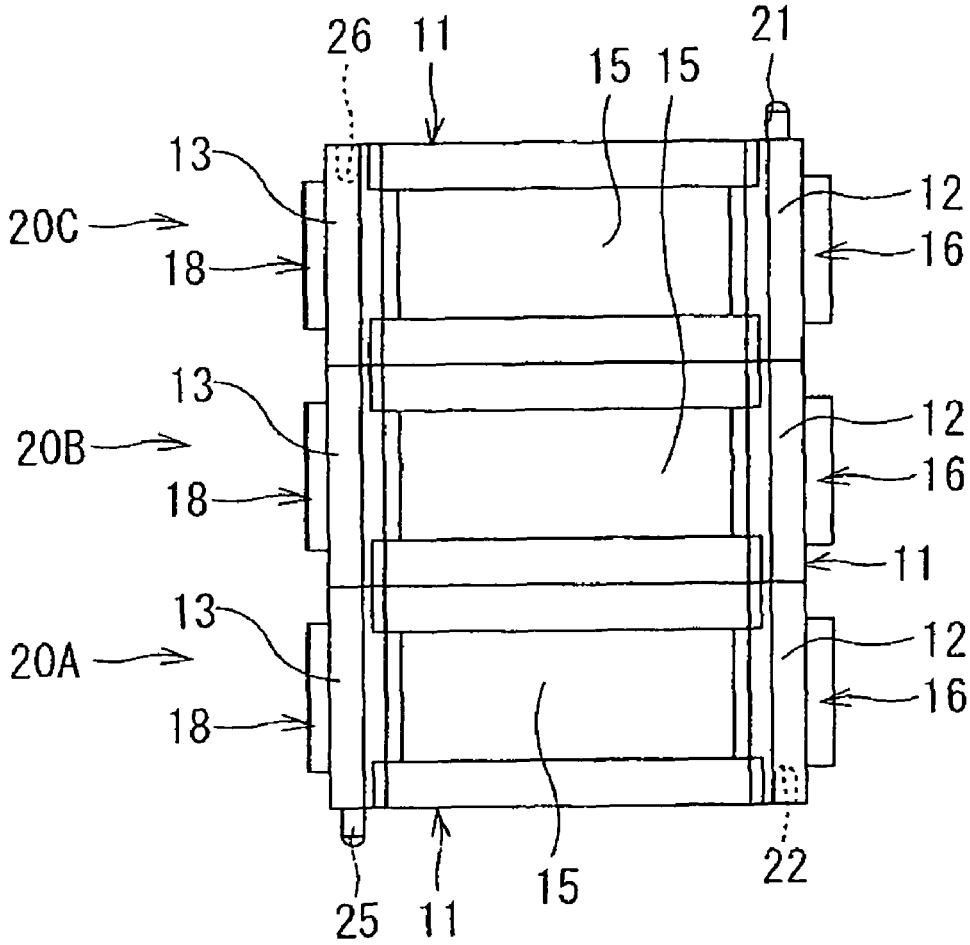
FIG. 15 is a plan view showing a state in which the three bobbin holding clips are serially connected in the column direction.

Next, a description will be given of a method for connecting three bobbin holding clips 20A, 20B, and 20C in the column direction with reference to FIGS. 14 and 15. For example, the bobbin holding clips 20A, 20B, and 20C will be disposed in this order from the front side to the rear side. In this condition, the protrusion portion 21 of the bobbin holding clip 20A faces to the fitting hole 22 of the bobbin holding clip 20B. Further, the fitting hole 26 of the bobbin holding clip 20A faces to the protrusion portion 25 of the bobbin holding clip 20B. Also, the protrusion portion 21 of the bobbin holding clip 20B faces to the fitting hole 22 of the bobbin holding clip 20C. Further, the fitting hole 26 of the bobbin holding clip 20B faces to the protrusion portion 25 of the bobbin holding clip 20C.

With this, first, the bobbin holding clip 20A is pressed into the front side of the bobbin holding clip 20B. It causes the protrusion portion 21 of the bobbin holding clip 20A to be fitted into the fitting hole 22 of the bobbin holding clip 20B. Further, the protrusion portion 25 of the bobbin holding clip 20B is fitted into the fitting hole 26 of the bobbin holding clip 20A. In such a manner, the bobbin holding clips 20A and 20B can be serially connected in the column direction. Subsequently, the bobbin holding clip 20C is pressed into the rear side of the bobbin holding clip 20B. It causes the protrusion portion 21 of the bobbin holding clip 20B to be fitted into the fitting hole 22 of the bobbin holding clip 20C. Further, the protrusion portion 25 of the bobbin holding clip 20C is fitted into the fitting hole 26 of the bobbin holding clip 20B. In such a manner, the bobbin holding clips 20A, 20B, and 20C can be serially connected in the column direction.

Figure 16:
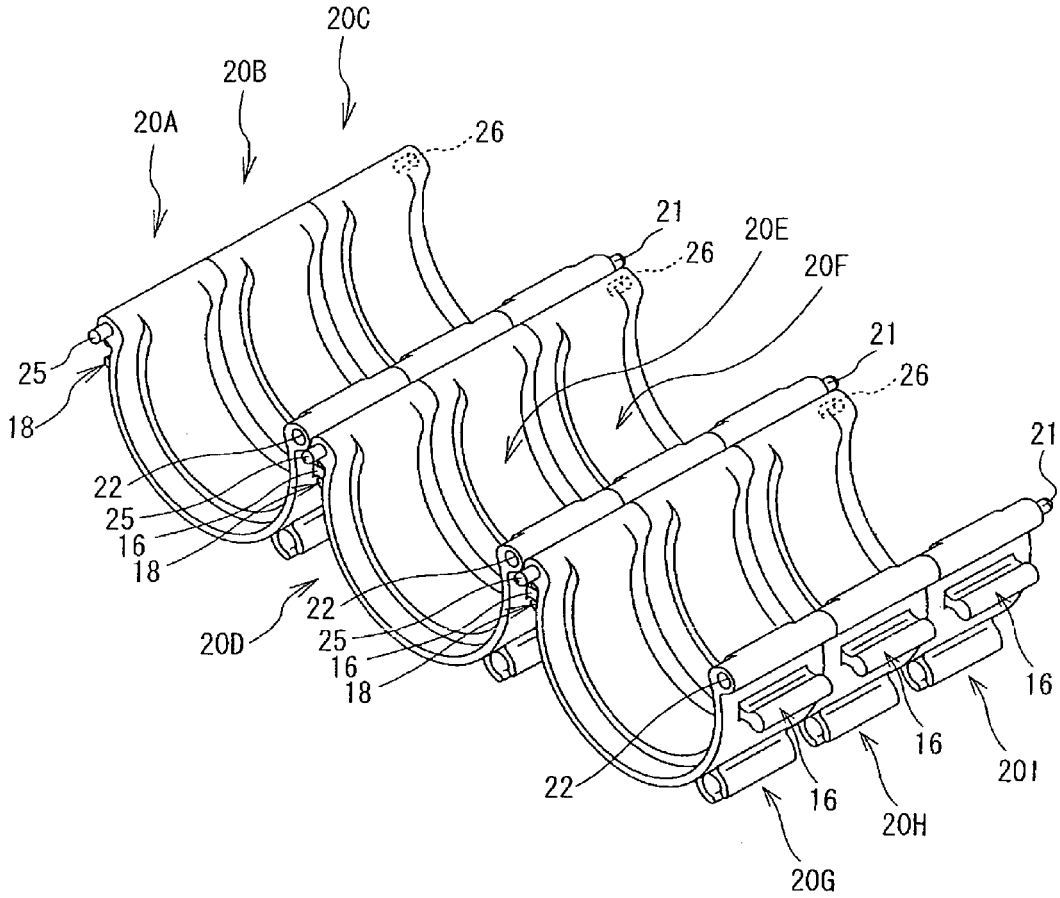
FIG. 16 is a perspective view showing a state in which nine bobbin holding clips are serially connected in two directions of the row direction and the column direction.

Further, the bobbin holding clip 20 has all the components of the bobbin holding clip 10 of the first embodiment, so that these clips 20 can be connected not only in the row direction but also in the column direction. For example, as shown in FIG. 16, nine bobbin holding clips 20A to 20I can be connected in two direction of the row and column directions. FIG. 16 shows a state that three groups of the three bobbin holding clips 20A to 20C serially connected in the column direction, the three bobbin holding clips 20D to 20F serially connected in the column direction, and the three bobbin holding clips 20G to 20I serially connected in the column direction are connected with each other in the row direction. A plurality of the bobbin holding clips 20 can thus be connected in two directions of the row and column directions and so can be articulated in a larger number of forms.

As described above, the bobbin holding clip 20 of the second embodiment is a variant of the bobbin holding clip 10 according to the first embodiment. The protrusion 21 is provided at the rear end of the right-side opening end portion 12 of the bobbin holding clip 20 and the fitting hole 22 is formed at the front end thereof into which the protrusion portion 21 of another bobbin holding clip 20 is fitted. On the other hand, the protrusion 25 is formed at the front end of the left-side opening end portion 13 and the fitting hole 26 is formed at the rear end into which the protrusion portion 25 of another bobbin holding clip 20 is fitted. By providing such a structure, other bobbin holding clips 20 can be connected not only in the row direction but also in the column direction.

Next, a storage case 30 of a third embodiment will be described with reference to FIGS. 17 and 18. It should be noted that sewing machine accessories are assumed to refer to various parts such as a bobbin, a variety of pressers, a pair of scissors to cut off a thread, a needle, and a screwdriver. The storage case 30 will be used to store these sewing machine accessories in order.

Figure 17:
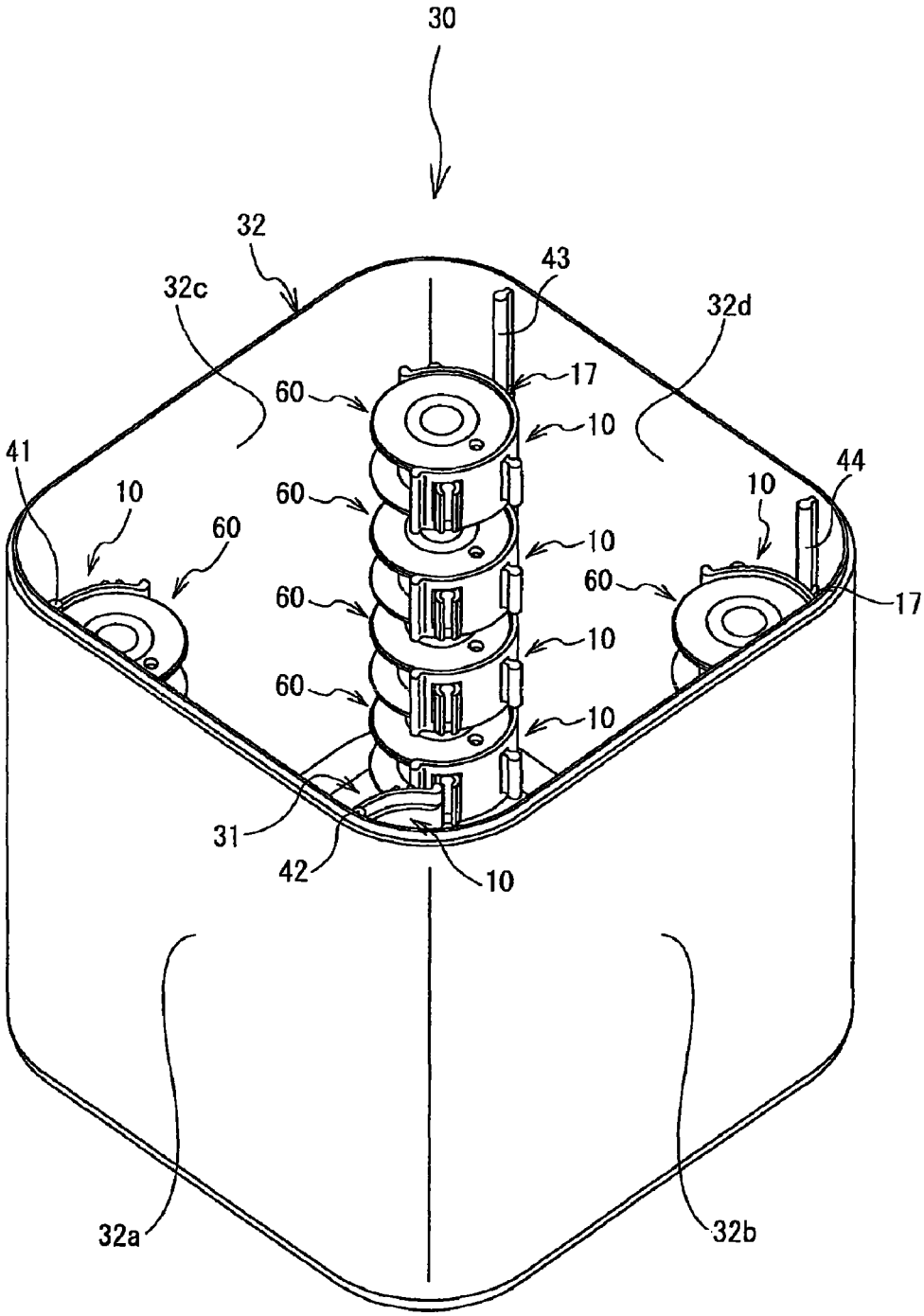
FIG. 17 is a perspective view of a storage case.
Figure 18:
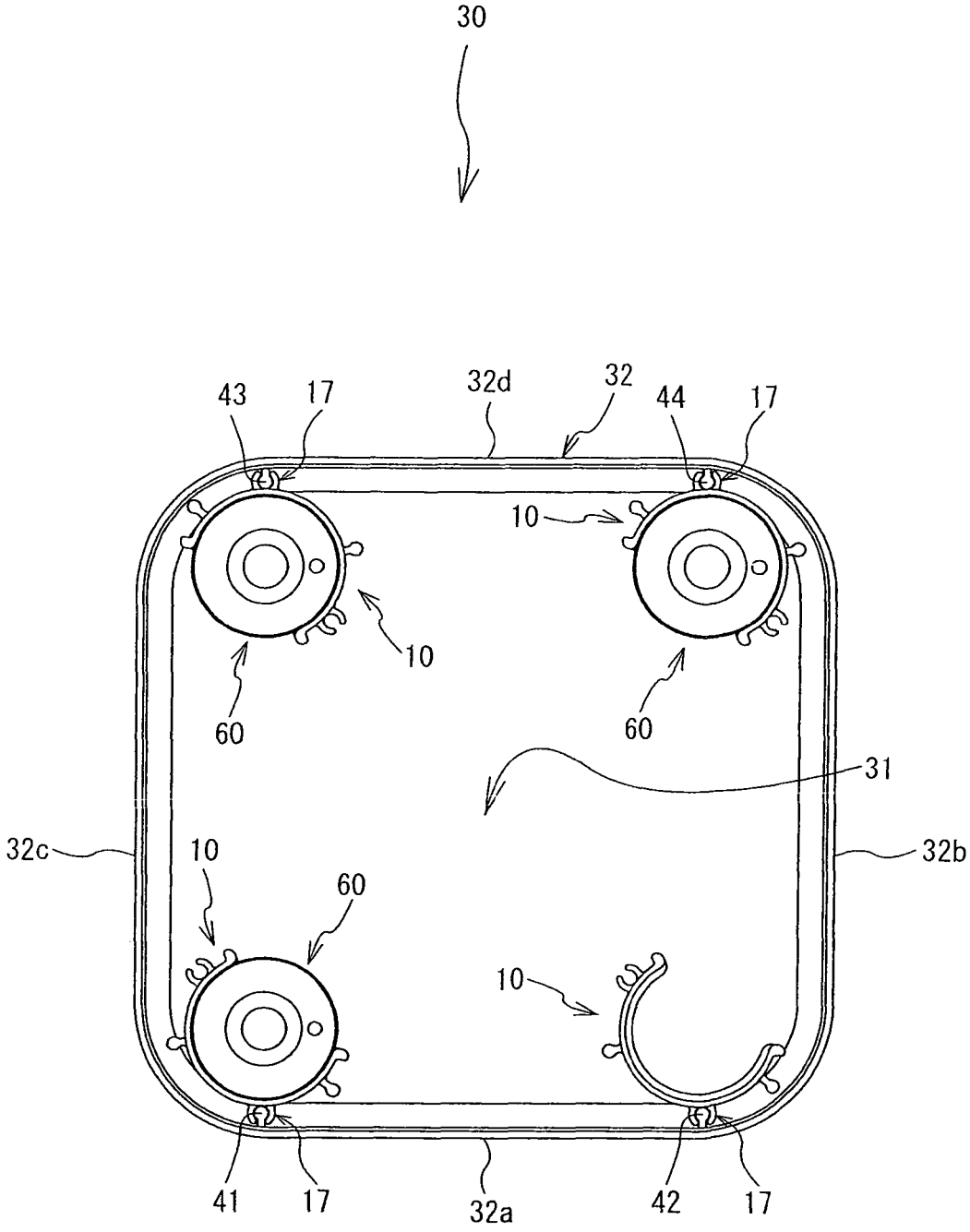
FIG. 18 is a plan view of the storage case.

As shown in FIGS. 17 and 18, the storage case 30 is comprised of a substantially rectangular solid-shaped box having an open top surface. The storage case 30 is configured of a bottom wall 31 formed in a substantially rectangle-shaped as viewed in ground plan and a side wall 32 which is erected along the outer periphery of this bottom wall 31. Further, the side wall 32 is configured of a front wall 32*a*, a right-side wall 32*b*, a left-side wall 32*c*, and a rear wall 32*d*. At curves of the wall are formed a corner where the front wall 32*a* and the right-side wall 32*b* are coupled, a corner where the front wall 32*a* and the left-side wall 32*c* are coupled, a corner where the rear wall 32*d* and the right-side wall 32*b* are coupled, and a corner where the rear wall 32*d* and the left-side wall 32*c* are coupled, respectively.

Further, on the left side of the inner surface of the front wall 32*a*, a rib 41 is formed which extends along a portion near the corer where the front wall 32*a* and the left-side wall 32*c* are coupled, which projects toward the rear wall 32*d*, and whose tip expands in a cross-sectional Ω-shape. On the other hand, on the right side of the inner surface of the front wall 32*a*, a rib 42 is formed which extends along a portion near the corer where the front wall 32*a* and the right-side wall 32*b* are coupled, which projects toward the rear wall 32*d*, and whose tip expands in the cross-sectional Ω-shape. Further, on the left side of the inner surface of the rear wall 32*d*, a rib 43 is formed which extends along a portion near the corer where the rear wall 32*d* and the left-side wall 32*c* are coupled, which projects toward the front wall 32*a*, and whose tip expands in the cross-sectional Ω-shape. On the other hand, on the right side of the inner surface of the rear wall 32*d*, a rib 44 is formed which extends along a portion near the corer where the rear wall 32*d* and the right-side wall 32*b* are coupled, which projects toward the front wall 32*a*, and whose tip expands in the cross-sectional Ω-shape. These ribs 41 to 44 have the same cross-sectional shapes as those of the first fitting portion 16 and the second fitting portion 19 of the bobbin holding clip 10 shown in FIG. 1. That is, it is possible to fit the first fitting target portion 17 or the second fitting target portion 18 of the bobbin holding clip 10 to the ribs 41 to 44. It should be noted that although in the present embodiment, the ribs 41 to 44 have been formed along the portions near the respective four corners of the side wall 32, they may be formed along the respective corners or substantially at the centers of the side walls 32 (front wall 32*a*, right-side wall 32*b*, left-side wall 32*c*, and rear wall 32*d*) respectively.

By fitting the first fitting target portion 17 of the bobbin holding clip 10 holding the bobbin 60 to each of the ribs 41-44 as shown in FIGS. 17 and 18, for example, a plurality of the bobbin holding clips 10 can be attached. For example, by attaching the bobbin holding clip 10 holding a red thread to the rib 41, the bobbin holding clip 10 holding a black thread to the rib 42, the bobbin holding clip 10 holding a white thread to the rib 43, and the bobbin holding clip 10 holding a green thread to the rib 44, a plurality of the bobbins 60 can be stored in order. Moreover, the bobbin holding clips 10 may be attached along the portions near the corners of the storage case 30, thereby enabling forming a space at the center of the storage case 30. This formed space can be utilized as a space to store any other sewing machine accessories, thereby effectively utilizing the inner storage space of the storage case 30.

As described above, according to the storage case 30 of the third embodiment, the ribs 41 to 44 are provided along the portions near the four corners of the side wall 32. These ribs 41 to 44 have the same cross-sectional shapes as those of the first fitting portion 16 and the second fitting portion 19 of the bobbin holding clip 10. That is, it is possible to fit the first fitting target portion 17 or the second fitting target portion 18 of the bobbin holding clip 10 to the ribs 41 to 44. Therefore, the bobbin holding clips 10 can be attached detachably to the inner side surfaces of the storage case 30. Further, it is possible to arbitrarily adjust the number of bobbin holding clips 10 to be attached according to the number of the bobbins 60 to be stored in the storage case 30, thereby appropriately changing the storage space of the storage case 30. That is, the storage case 30 easy to use can be provided. Moreover, since the bobbin holding clips 10 are attached along the portions near the corners of the storage case 30, a space can be formed at the center of the storage case 30. This formed space can be utilized as a space to store any other sewing machine accessories, thereby effectively utilizing the inner storage space of the storage case 30.

Next, a storage case 50 of a fourth embodiment will be described with reference to FIGS. 19 and 20.

Figure 19:
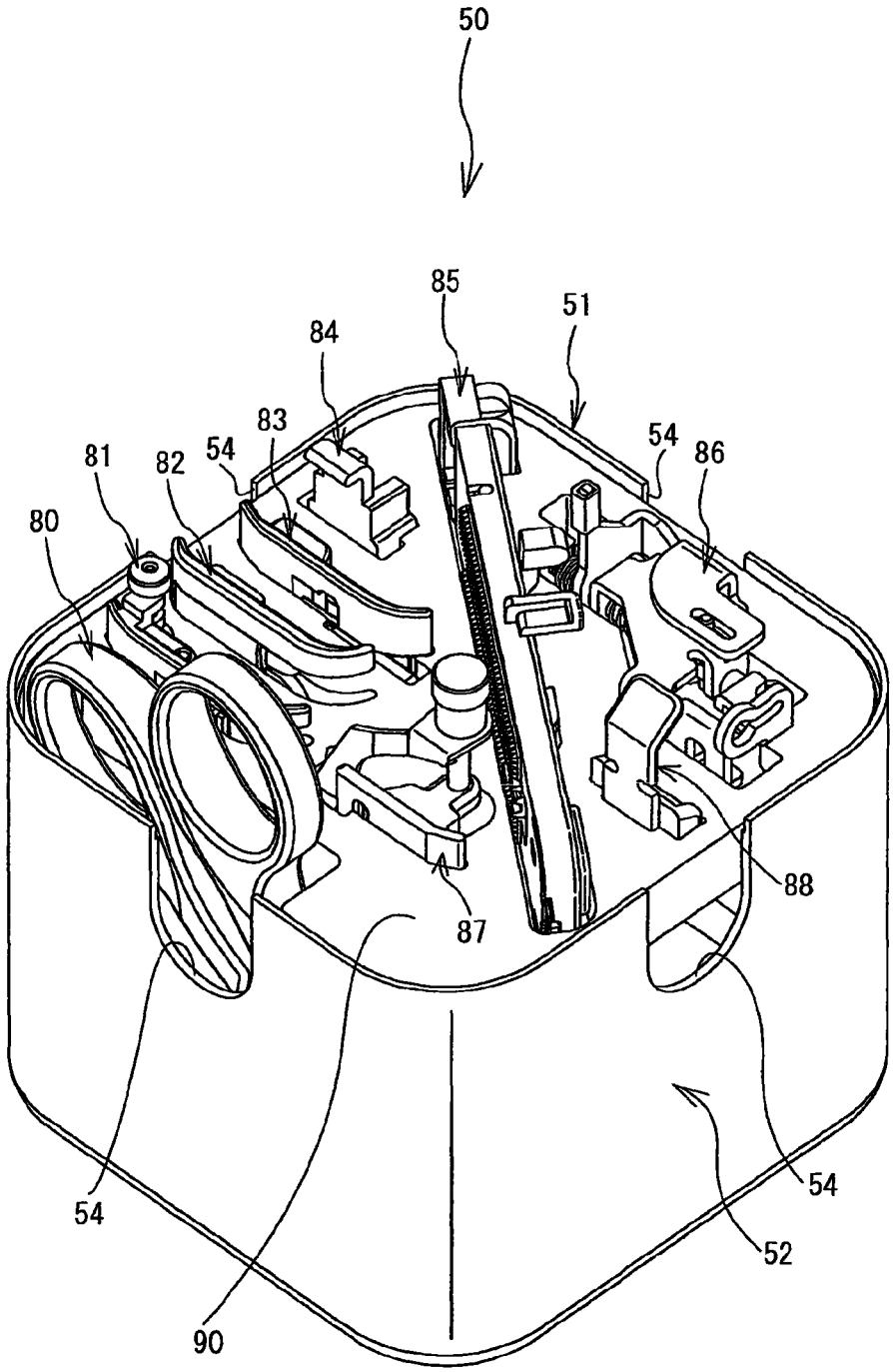
FIG. 19 is a perspective view of a case body of the storage case in which sewing machine accessories are stored.

The storage case 50 shown in FIG. 19 is comprised of a substantially rectangular solid-shaped case body 51 having an open top surface like the storage case 30. Further, a cutout hole 54 which is U-shaped as viewed from front is formed at each of the upper end portions of a front wall, a right-side wall, a left-side wall, and a rear wall that configure a side wall 52 which is rectangle-shaped as viewed in ground plan. Besides, inside the storage case 50, a part support plate 90 which is substantially rectangle-shaped as viewed in ground plan and used to support sewing machine accessories is fitted and locked at a shoulder (not shown) provided at the upper stage of the inner surface of the side wall 52. The part support plate 90 is a plate member which has a predetermined thickness and is made of a synthetic resin. In its upper surface, a plurality of support holes and cutouts which match the shapes of the various sewing machine accessories are formed respectively. For example, the part support plate 90 shown in FIG. 19 may support a pair of scissors 80, a zigzag presser 81, a pattern stitch presser 82, a cut-edge whipstitch presser 83, a button-sewing presser 84, a button-hole whipstitch presser 85, an embroidery presser 86, a whipstitch presser 87, and a biased presser 88 respectively.

Figure 20:
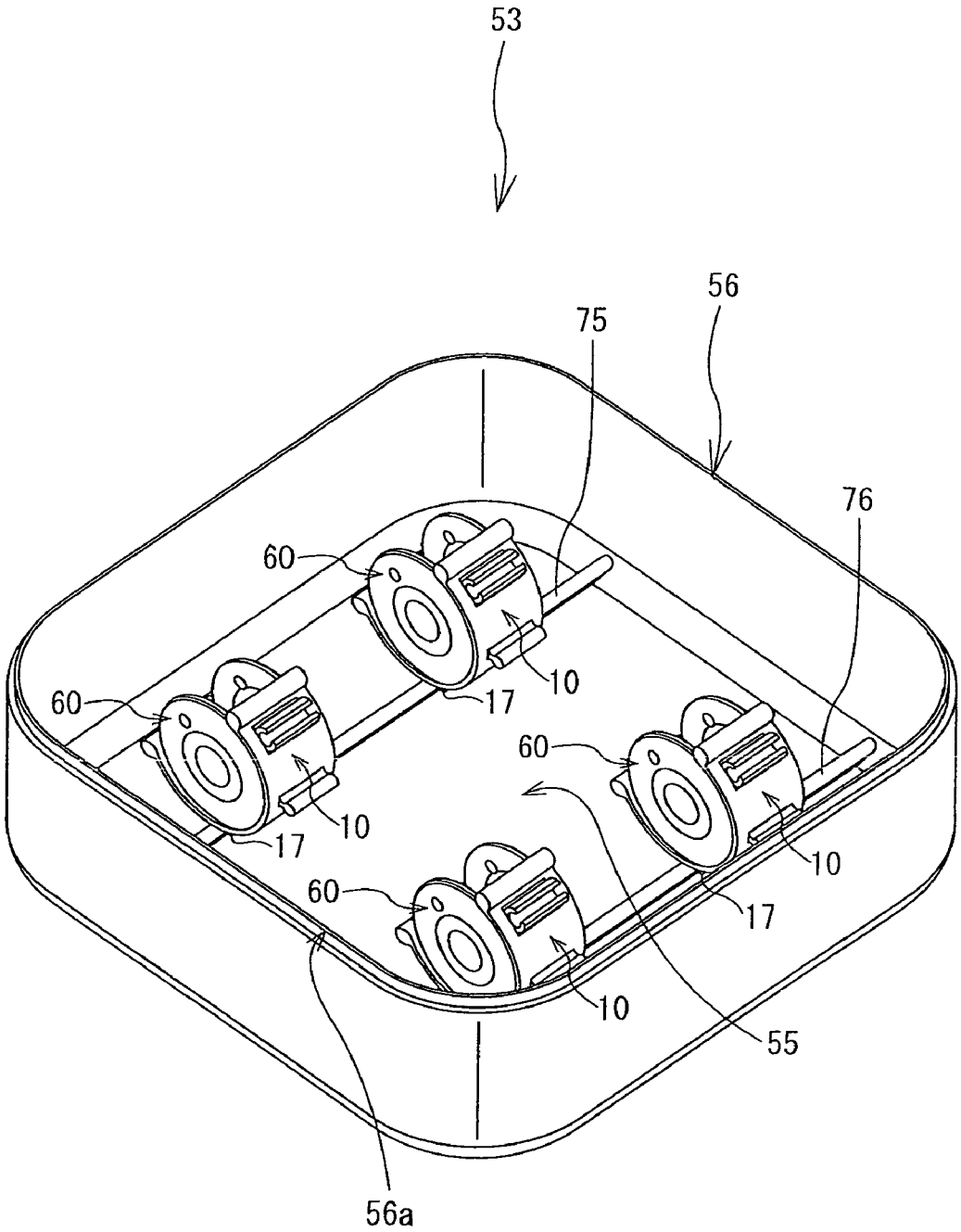
FIG. 20 is a perspective view showing a back side of a cap.

Such a storage case 50 is additionally provided with a cap 53 shown in FIG. 20. The cap 53 is configured of a top wall 55 which is substantially rectangle-shaped as viewed in ground plan and a side wall 56 which is erected along the outer periphery of this top wall 55. Note that the height of the side wall 56 is longer than the extreme breadth of the bobbin holding clip 10. Further, the side wall 56 has an engagement edge 56*a* which projects like a wall along the inner periphery of the side wall 56. If the engagement edge 56*a* is inserted along the inner surface of the side wall 52 of the storage case 50 until the end portion of the side wall 56 of the cap 53 is fitted to the upper end portion of the side wall 52 of the storage case 50, the storage case 50 is covered with the cap 53. On the back surface of such a cap 53 are mounted a pair of ribs 75 and 76 which extend parallel to each other in the front-and-rear direction. The ribs 75 and 76 each have a tip which expands in a cross-sectional Ω-shape, which is the same as the cross-sectional shape of the first fitting portion 16 and the second fitting portion 19 of the bobbin holding clip 10 shown in FIG. 2. That is, it is possible to fit the first fitting target portion 17 or the second fitting target portion 18 (see FIG. 2) of the bobbin holding clip 10 to the ribs 75 and 76.

By fitting the first fitting target portions 17 of the four bobbin holding clips 10 holding the bobbins 60 to the ribs 75 and 76 respectively as shown in FIG. 20, for example, the four bobbin holding clips 10 can be attached to the back surface of the cap 53. If then the cap 53 having the bobbin holding clips 10 attached thereto is disposed to cover the top of the storage case 50, the back surface of the cap 53 may be supported in a condition where a predetermined size of space is held with respect to the top portion of the storage case 50. That is, the bobbin holding clips 10 attached to the back surface of the cap 53 may be arranged not to interfere with the sewing machine accessories supported by the part support plate 90. It is thus possible to effectively utilize the inner storage space of the storage case 50.

As described above, the storage case 50 of the fourth embodiment is accompanied by the cap 53 to cover its open top surface. On the back surface of the cap 53 are mounted the pair of ribs 75 and 76 which extend parallel to each other in the front-and-rear direction. The ribs 75 and 76 each have a tip which expands in a cross-sectional Ω-shape, which is the same as the cross-sectional shape of the first fitting portion 16 and the second fitting portion 19 of the bobbin holding clip 10. That is, it is possible to fit the first fitting target portion 17 or the second fitting target portion 18 of the bobbin holding clip 10 to the ribs 75 and 76. Further, the back surface of the cap 53 may be supported in a condition where the predetermined size of space is held with respect to the top portion of the storage case 50. That is, the bobbin holding clips 10 attached to the back surface of the cap 53 may be arranged not to interfere with the sewing machine accessories supported by the part support plate 90. It is thus possible to effectively utilize the inner storage space of the storage case 50.

It is to be understood that the present disclosure is not limited to the aforesaid embodiments and can be changed variously. For example, although in the first and second embodiments, the bobbin holding clips 10 and 20 have been fitted with the two fitting portions (first fitting portion 16, first fitting target portion 17) and the two fitting portions (second fitting target portion 18, second fitting portion 19), only at least a pair of a fitting portion and a fitting target portion need to be provided. Further, a larger number of the fitting portions and the fitting target portions may be provided.

Further, although the center position of the first fitting portion 16 (center position of the Ω-shaped partial cylinder) and the center position of the second fitting target portion 18 (center position of the cross-sectional C-shaped partial cylinder hollow) of the bobbin holding clips 10 and 20 have been disposed so that they might be of substantially the same height and in a plane which would pass through the center position of the body portion 11 (center position of the cross-sectional C-shaped partial cylinder hollow) or in the vicinity thereof, the center position of the first fitting portion 16 and that of the second fitting target portion 18 in a condition where the bobbin 60 is held as shown in FIG. 7 may be disposed in the plane which passes through the center position of the bobbin 60 or in the vicinity thereof.

Further, the storage cases 30 and 50 of the respective third and fourth embodiments have been described in a case where they are fitted with the bobbin holding clip 10 of the first embodiment, the bobbin holding clips 20 may be attached instead.

Further, the ribs 41 to 44, 75, and 76 provided to the storage cases 30 and 50 of the respective third and fourth embodiments may have the cross-sectional C-shape, which is the same as that of the first fitting target portion 17 and the second fitting target portion 18, rather than the Ω-shape which is the same as the cross-sectional shape of the first fitting portion 16 and the second fitting portion 19 of the bobbin holding clip 10. In this case, it is possible to fit the first fitting portion 16 or the second fitting portion 19 to the ribs 41 to 44, 75 and 76.

Further, the number of the ribs provided to the storage cases 30 and 50 of the respective third and fourth embodiments is not limited to four or two and may be appropriately changed in accordance with the size of the storage cases 30 and 50.

The bobbin holding member according to the present disclosure can be utilized in the case of storing bobbins to be used in a sewing machine, in order.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A bobbin holding member configured to hold a bobbin, the member comprising:

a body portion configured to detachably hold an outer periphery of a brim portion provided to both ends of a middle body section of the bobbin, the body portion being elastically deformable and formed in a substantially C-shaped partial cylinder so that an inner side of the body portion is configured to hold the outer periphery of each brim portion of the bobbin by an elastic recovery force of the body portion;

a plurality of fitting portions, each fitting portion being formed on the body portion; and a plurality of fitting target portions, each fitting target portion being formed on the body portion and configured to be fitted to a fitting portion of another bobbin holding member.

2. The bobbin holding member according to claim 1, wherein:

the fitting portion is formed convexly;

the fitting target portion is formed in a concaved shape; and the fitting portion is fitted into the fitting target portion.

3. A storage case that stores sewing machine accessories, the case comprising:

a bottom wall;

a side wall erected from an outer peripheral edge of the bottom wall; and a case-side fitting portion, the case-side fitting portion being provided on an inner side surface of the side wall and along the inner side surface near corners of the side wall;

wherein the storage case is formed in a substantially rectangular shape as viewed in ground plan, and, the case-side fitting portion is fitted to a fitting portion or a fitting target portion provided on a bobbin holding member, the bobbin holding member comprising a body portion that is configured to detachably hold an outer periphery of a brim portion provided to both ends of a middle body section of a bobbin, the body portion including the fitting portion and the fitting target portion which is configured to be fitted to a fitting portion of another bobbin holding member.

4. The storage case according to claim 3, wherein the case-side fitting portion is formed in a shape of a rib.

5. A storage case that stores sewing machine accessories, the case comprising:

a case body whose one surface is open;

a cap that covers an open surface of the case body; and a cap-side fitting portion, the cap-side fitting portion being provided on a back surface of the cap;

wherein the cap-side fitting portion is fitted to a fitting portion or a fitting target portion provided on a bobbin holding member, the bobbin holding member comprising a body portion that is configured to detachably hold an outer periphery of a brim portion provided to both ends of a middle body section of a bobbin, the body portion including the fitting portion and the fitting target portion which is configured to be fitted to a fitting portion of another bobbin holding member.

* * * * *